US006029621A

United States Patent [19]

Berels

[11] Patent Number: 6,029,621

[45] Date of Patent: Feb. 29, 2000

[54] REMOTELY CONTROLLED ENGINE PRELUBRICATION SYSTEM

[75] Inventor: David Berels, Belleville, Mich.

[73] Assignee: Lear Automotive Dearborn, Inc., Southfield, Mich.

[21] Appl. No.: 09/086,207

[22] Filed: May 28, 1998

[51] Int. Cl.[7] ..... F01M 1/00

[52] U.S. Cl. ..... 123/196 S; 184/6.4

[58] Field of Search ..... 123/196 S, 179.2; 184/6.3, 6.4

[56] References Cited

U.S. PATENT DOCUMENTS

| | | | |
|---|---|---|---|
| 4,168,693 | 9/1979 | Harrison | 123/196 S |
| 4,236,594 | 12/1980 | Ramsperger | 123/179.2 |
| 4,628,877 | 12/1986 | Sundles et al. | 123/196 S |
| 5,121,720 | 6/1992 | Roberts | 123/196 S |
| 5,155,995 | 10/1992 | Kinnear et al. | 123/179.2 |
| 5,460,097 | 10/1995 | Nekola | 123/196 S |
| 5,511,522 | 4/1996 | Tran | 123/196 S |
| 5,736,935 | 4/1998 | Lambropoulos | 123/179.2 |
| 5,743,231 | 4/1998 | Reinosa | 123/196 S |

*Primary Examiner*—Noah P. Kamen

*Attorney, Agent, or Firm*—MacMillan, Sobanski & Todd, LLC

[57] ABSTRACT

An inventive system lubricates an engine with oil prior to starting the engine. In one embodiment, the system includes an electric engine oil pump for lubricating the engine, a transmitter for transmitting a radio frequency signal, and a receiver for receiving the radio frequency signal and for actuating the electric engine oil pump. The oil pump is actuated when a driver uses the transmitter to remotely unlock the doors of the vehicle. In this manner, the driver passively actuates the oil pump prior to starting the engine.

10 Claims, 1 Drawing Sheet

REMOTELY CONTROLLED ENGINE PRELUBRICATION SYSTEM

BACKGROUND OF THE INVENTION

This invention relates to a remotely controlled engine oil pump which begins lubricating an engine prior to starting the engine.

Nearly all modern automotive vehicles are powered by an internal combustion engine having a lubrication system filled with engine oil. Proper lubrication is essential to the operation of the engine. Without lubrication, the effects of friction and heat would cause the engine to seize. To distribute the engine oil to numerous moving components inside the engine, the lubrication system includes an oil pump.

Engine oil pumps create pressure to circulate the oil throughout the lubrication system. Most engine oil pumps are mechanically driven by the engine. Typically, engine oil pumps are driven by the circular rotation of either the camshaft or the crankshaft and, therefore, the oil is distributed only when the engine is running. As a result, the greatest amount of frictional component wear occurs when the engine is first started. Lubricating the engine with oil prior to starting, sometimes referred to as prelubricating the engine, would greatly reduce this start-up friction wear which, in turn, would lengthen the life of the engine. Accordingly, it would be desirable to provide an engine lubrication system in which a driver passively activates an electrically driven engine oil pump prior to starting the engine. However, since the oil pump is typically driven by the engine this has not yet been provided.

SUMMARY OF THE INVENTION

In a disclosed embodiment of this invention, a remotely controlled engine prelubrication system consists of an electric engine oil pump for lubricating an internal combustion engine, a transmitter for transmitting a radio frequency signal, and a receiver for receiving the radio frequency signal and for actuating the electric engine oil pump. Preferably, an electric motor drives the oil pump and a radio frequency receiver connects the electric motor to a power supply in response to a radio frequency signal.

In a preferred embodiment of this invention, the oil pump is actuated when a driver uses the transmitter to provide an indication that engine may soon be started, such as remotely unlocking the doors of the vehicle. In this manner, the driver passively actuates the oil pump prior to starting the engine. If after a short period of time the engine is not started, the oil pump is switched off.

These and other features of the present invention will be best understood from the following specification and drawings, the following of which is a brief description.

DETAILED DESCRIPTION OF THE PREFERRED EMBODIMENT

Figure 1:
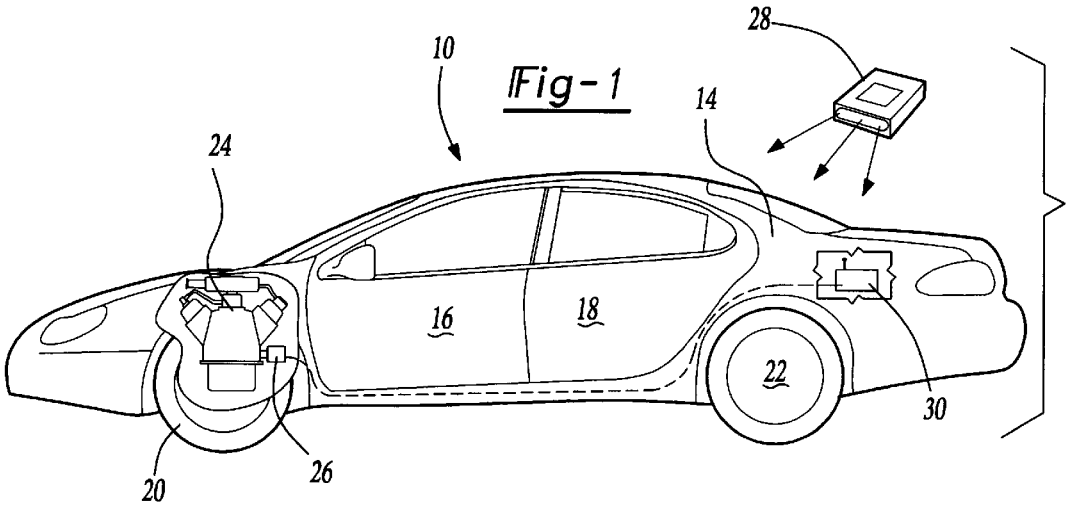
FIG. 1 is a fragmentary perspective view of a vehicle in accordance with the present invention including a remotely controlled engine prelubrication system.

FIG. 1 is a fragmentary perspective view of a vehicle 10 in accordance with the present invention including a remotely controlled engine prelubrication system 12. The vehicle 10 includes a body 14 having doors 16 and 18, wheels 20 and 22 supporting the body 14, and an internal combustion engine 24 for powering the vehicle 10. The engine 24 is filled with engine oil to lubricate numerous moving components.

Figure 2:
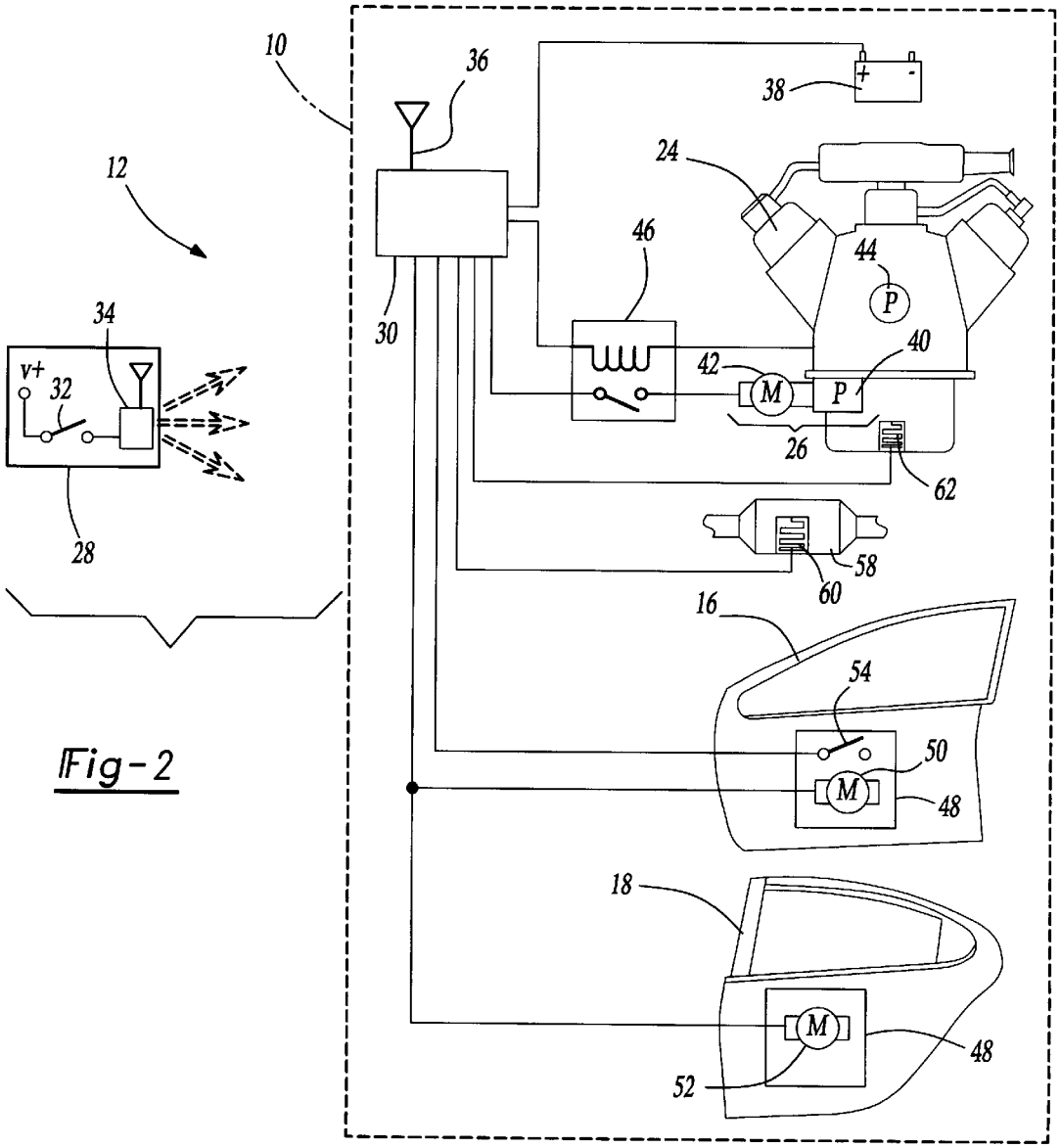
FIG. 2 is an electrical schematic diagram of the remotely controlled engine prelubrication system in accordance with the present invention.

FIG. 2 is an electrical schematic diagram of the remotely controlled engine prelubrication system 12 in accordance with the present invention. The remotely controlled engine prelubrication system 12 includes an electric engine oil pump 26 for lubricating the engine 24, a portable transmitter 28 for transmitting a radio frequency signal, and a receiver 30 for receiving the radio frequency signal and for activating the oil pump 26. The transmitter 28 is of a conventional design and, thus, includes an input switch 32 and a transmitter circuit 34 which broadcasts a unique radio frequency signal when the input switch 32 is depressed. The receiver 30 includes an antenna 36 for capturing local airborne radio frequency signals. Upon receipt of the unique radio frequency signal, the receiver 30 actuates the oil pump 26, such as by supplying power from an electrical power supply 38 directly to the oil pump 26 or by switching power from the power supply 38 to the oil pump 26 through a relay or other components.

In one embodiment of the present invention, the electric oil pump 26 is comprised of a conventional pump 40 electrically driven by an electric motor 42. In this embodiment, the motor 42 drives the pump 40 during both the prelubrication and operation of the engine 24. One skilled the art will recognize that the pump 40 could be driven electrically by the motor 42 during prelubrication and driven mechanically by the circular rotation of an engine camshaft or engine crankshaft during operation of the engine 24. In another embodiment of the present invention, the vehicle 10 includes both the electric oil pump 26 and an engine driven oil pump 44. In this embodiment, the receiver 30 actuates the electric oil pump 26 only to prelubricate the engine 24 with engine oil. Thereafter, the engine driven oil pump 44 distributes and circulates the engine oil as the engine 24 is running. A cut-off 46 disconnects the power supply 38 from the electric oil pump 26 when the engine 24 is running. One of ordinary skill in the art will recognize that the cut-off 46 may be accomplished with a relay or other controls.

The vehicle 10 further includes an electrically actuated accessory 48 remotely controlled by the transmitter 28 via the receiver 30. Upon receipt of the unique radio frequency signal from the transmitter 28, the receiver 30 actuates both the accessory 48 and the oil pump 26. Preferably, the accessory 48 comprises door locks 50 and 52 for locking and unlocking the doors 16 and 18 respectively. In response to receipt of the unique radio frequency signal, the receiver 30 actuates the oil pump 26 and connects the power supply 38 to the door locks 50 and 52 to unlock the doors 16 and 18 respectively. As a result, the oil pump 26 is passively actuated by a driver when the input switch 32 of the transmitter 28 is depressed to unlock the doors 16 and 18. In this manner, the engine 24 is prelubricated with engine oil prior to starting the engine 24.

With regard to the vehicle door lock system, the remotely controlled engine prelubrication system 12 further includes a key operated switch 54, such as a key lock cylinder switch, used to unlock one of the vehicle doors 16 or 18. Preferably, the key operated switch 54 is used to unlock the driver's door 16. When the respective door 16 or 18 is manually unlocked with a mechanical key, the key operated switch 54 signals the receiver 30 to actuate the oil pump 26. In this manner, the oil pump 26 is actuated as the driver enters the vehicle 10 before the engine 24 is started.

The vehicle 10 also includes a catalytic converter 58 and additional electrically actuated accessories including a catalytic converter heater 60 and an engine oil heater 62. Upon receipt of the unique radio frequency signal, the receiver 30 actuates the catalytic converter heater 60 to warm the catalytic converter 58 and actuates the engine oil heater 62 to warm the engine oil. Preferably, the catalytic converter heater 60 and the engine oil heater 62 are actuated when the driver depresses the input switch 32 of the transmitter 28 to unlock the doors 16 and 18. In this manner, the catalytic converter 58 and the engine oil are warmed prior to starting the engine 24.

A timer can be incorporated into the remotely controlled engine prelubrication system 12 to stop the oil pump 26 after a predetermined period of time if the engine 24 has not been started. Further, the accessory 48 controlled by the transmitter 28 may be an engine ignition switch used to remotely start the engine 24. In this embodiment, the receiver 30 may be programmed to actuate the oil pump 26 before the engine 24 is remotely started.

One of ordinary skill in the art will appreciate that the receiver 30 may be programmed to actuate the oil pump 26 and any combination of accessories including the door locks 50 and 52, the catalytic converter heater 60, the engine oil heater 62, and the engine ignition switch upon receipt of the unique radio frequency signal.

Preferred embodiments of this invention have been disclosed, however, a worker of ordinary skill in the art would recognize that certain modifications would come within the scope of this invention. For that reason, the following claims should be studied to determine the true scope and content of this invention.

What is claimed is:

1. A vehicle comprising:

an internal combustion engine, an oil pump for lubricating said engine prior to operation of said engine, an electric motor for driving said pump, and a key operated switch for manually unlocking at least one door of said vehicle and actuating said oil pump in response to manually unlocking the at least one door of said vehicle.

2. A system for lubricating an internal combustion engine in a vehicle, the system comprising:

an electric engine oil pump for lubricating the engine;

an accessory;

a transmitter for transmitting a radio frequency signal; and a receiver for receiving the radio frequency signal and actuating said accessory and said electric engine oil pump, wherein said receiver actuates said oil pump and connects said accessory prior to operation of said engine in response to the radio frequency signal, and wherein said accessory is the vehicle door locks.

3. A system as set forth in claim 2 wherein said electric engine oil pump is stopped after a predetermined period of time if said engine is not started.

4. A vehicle comprising:

an internal combustion engine, an oil pump for lubricating said engine prior to operation of said engine, an electric motor for driving said pump, an electric power supply, a radio frequency receiver for selectively connecting said electric motor to said power supply in response to a radio frequency signal, a transmitter for transmitting the radio frequency signal, and an electrical actuated accessory selectively connected to said power supply by said receiver when said electric motor is connected to said power supply, wherein said receiver actuates said oil pump and connects said power supply to said accessory prior to operation of said engine in response to the radio frequency signal, and wherein said accessory comprises door locks for locking and unlocking the doors of the vehicle in response to the radio frequency signal.

5. A vehicle as set forth in claim 4 including an engine driven oil pump for lubricating said engine during operation of said engine.

6. A vehicle as set forth in claim 4 including a cut-off for disconnecting said electric motor from said power supply in response to operation of said engine.

7. A vehicle as set forth in claim 4 including a key operated switch for unlocking the doors and actuating said oil pump in response to manually unlocking the doors.

8. A vehicle as set forth in claim 4 wherein said accessory comprises an engine oil heater for warming the engine oil in response to the radio frequency signal.

9. A vehicle as set forth in claim 4 wherein said accessory comprises a catalytic converter heater for warming the catalytic converter in response to the radio frequency signal.

10. A vehicle as set forth in claim 4 wherein said transmitter transmits the radio frequency signal to said receiver for actuating both said electric motor driven oil pump and said accessory.

* * * * *